US005470086A

United States Patent [19]

Peterson et al.

[11] Patent Number: 5,470,086

[45] Date of Patent: Nov. 28, 1995

[54] IN-LINE ROLLER SKATE ASSEMBLY

[75] Inventors: Tom Peterson; Neal Piper, both of Huntington Beach, Calif.

[73] Assignee: The Hyper Corporation, Huntington Beach, Calif.

[21] Appl. No.: 188,235

[22] Filed: Jan. 28, 1994

[51] Int. Cl.[6] ..... A63C 17/06; A63C 17/22

[52] U.S. Cl. ..... 280/11.22; 280/11.27; 301/5.7

[58] Field of Search ..... 280/11.19, 11.22, 280/11.23, 11.27; 301/5.3, 5.7

[56] References Cited

U.S. PATENT DOCUMENTS

| | | | |
|---|---|---|---|
| D. 301,908 | 7/1989 | Olson et al. | D21/226 |
| D. 321,393 | 11/1991 | Olson et al. | D21/226 |
| D. 323,540 | 1/1992 | Graham | D21/224 |
| D. 324,713 | 3/1992 | Rubin | D21/224 |
| D. 334,225 | 3/1993 | Graham | D21/224 |
| 1,428,210 | 9/1922 | Boche | 280/11.22 |
| 1,618,496 | 2/1927 | Ware . | |
| 1,674,087 | 6/1928 | Beemer | 301/5.7 |
| 1,697,485 | 1/1929 | Ware . | |
| 2,276,570 | 3/1942 | Gaines | 280/11.27 X |
| 3,501,162 | 3/1970 | Toone | 280/11.23 |
| 3,900,203 | 8/1975 | Kukulowicz | 280/11.2 |
| 4,218,098 | 8/1980 | Burton | 301/5.7 |
| 4,273,345 | 6/1981 | Ben-Dor et al. | 280/11.2 |
| 4,294,455 | 10/1981 | Krueger | 280/11.2 |
| 4,603,025 | 7/1986 | Landay et al. | 264/242 |
| 4,603,868 | 8/1986 | Schütz | 280/7.13 |
| 4,666,169 | 5/1987 | Hamill et al. | 280/11.23 |
| 4,909,523 | 3/1990 | Olson | 280/11.2 |
| 5,028,058 | 7/1991 | Olson | 280/11.22 |
| 5,048,848 | 9/1991 | Olson et al. | 280/11.22 |
| 5,068,956 | 12/1991 | Malewicz | 29/437 |
| 5,092,614 | 3/1992 | Malewicz | 280/11.22 |
| 5,190,301 | 3/1993 | Malewicz | 280/11.22 |
| 5,226,673 | 7/1993 | Cech | 280/11.22 X |
| 5,251,920 | 10/1993 | McHale | 280/1.19 |

FOREIGN PATENT DOCUMENTS

| | | | |
|---|---|---|---|
| 816753 | 4/1937 | France | 280/11.22 |
| 329221 | 9/1935 | Italy | 280/11.27 |

*Primary Examiner*—Brian L. Johnson
*Attorney, Agent, or Firm*—Fulwider, Patton, Lee & Utecht

[57] ABSTRACT

A skate wheel hub assembly incorporating confronting hub rims cooperating to form at their radial outer extremities a V-shaped tire seat. The tire seat supports an elastomeric tire having a rigid mounting ring projecting radially inwardly. The mounting ring is locked between the confronting rims to eliminate relative movement between the tire and the wheel hub. In one form, the bearing assemblies may be offset in staggered relation on alternating opposite sides of a longitudinal skate center line.

20 Claims, 5 Drawing Sheets

IN-LINE ROLLER SKATE ASSEMBLY

BACKGROUND OF THE INVENTION

1. Field of the Invention

The invention relates to in-line roller skates and more particularly to an improved mechanical lock for linking the hub and the tire of an in-line roller skate as well as loading of the wheel bearings.

2. Description of the Prior Art

In-line roller skating is a popular recreational activity. A growing commercial market for such skates has developed in the United States and elsewhere in response to this trend. The market is directed to providing a faster and more responsive skate that is easily manufactured. The term "in-line skating" is derived from the arrangement of the skate's wheels. In-line skate wheels are arranged longitudinally one behind the other so that the wheels rotate in the same longitudinally oriented vertical plane, similar to ice skating where there is a blade all in one plane. This aligned arrangement of wheels approximates the blade of an ice skate. By arranging the wheels of a roller skate in the same vertical plane, resistance to turning the skate is minimized.

In-line roller skate wheel arrangements often have an elastomeric tire bonded around a wheel hub assembly. The hub and wheel arrangement typically incorporate either dual or single bearing assemblies. In either case, the hub has typically been constructed of hard plastic with a soft elastomeric tire bonded to the radially outer surface thereof. In recognition of the difficulty in maintaining the bond between the tire and hub and of the intricacies of the load carrying requirements, the rims at the outer edges of the hubs have been formed in many different configurations. Examples include configurations where the radially outer surfaces are flat in the axle direction, slightly convex to be formed with a slightly raised central portion or even somewhat V-shaped to form a radially outwardly raised central rib about which the tire is fitted to be bonded thereonto. Often times the tire also includes a shock absorbing element such as a hard ring embedded in the tire or even a soft annular tube embedded in the tire. Such hub and tire arrangements, in practice, must bear various different and varying load vectors which subject the tire to both axial and lateral displacement and, of course, flex the configuration of the tire at the point where the load is carried. When the wheels are in rotational longitudinal movement the portion of the tire in contact with the road surface elastically deforms causing other portions of the elastomeric tire to bulge, most prominently occurring at the portion of the tire ahead of the portion contacting the surface. The bulge tends to squat ahead of the tangent to the vertical diameter physically resisting the rotation of the skate wheel. Such continuous transformational bulging also tends to, over time, cause the elastomeric tire to slip and break from bonded relation and sometimes even roll off the wheel hub, thus subjecting the skater to possible injury.

Prior efforts to provide a hub configured to mechanically lock the tire in place have included a hub assembly with two side plates clamped together to trap roller bearings in a track surrounding the axle and at the outer edge clamping against the opposite sides of an annular tire rib. U.S. Pat. No. 1,618,496 to Ware is an example of this type of arrangement. Wheel hubs of this type are unsatisfactory for present day high-performance wheels requiring smooth bearing performance and a positive lock of the tire in position.

Other efforts to provide a satisfactory hub and wheel arrangement have lead to proposing a hub and bearing assembly about an axle tube and circumscribed by annular rings intended to clamp at their radially outer extremities against the opposite sides of a tire configured with laterally disposed tire seats. A device of this type is shown in U.S. Pat. No. 1,697,485 to Ware. Such an arrangement fails to provide for a relatively rigid force line to the hub and positive locking of the tire against movement relative to the hub. Thus, there exists a need for a skate wheel assembly wherein the hub is positively linked to the wheel to securely lock the wheel in position and prevent rotation of the tire relative to the hub.

In-line roller skate wheels generally incorporate either dual or single bearing assemblies centered axially in the wheel hubs in series along a straight longitudinal center line under the skate shoe. The mechanical relationship of the outer and inner races around the bearings often lacks precision due to cost-determined manufacturing tolerances. This lack of precision causes wandering and play between the outer bearing race and the inner bearing race, and thus wandering and play between the elastomeric tire and the axle as the wheels rotate about their axes. This shortcoming causes uneven wear to the bearings, the wheel hubs, and the elastomeric tires. Additionally, the cost driven lack of precision in some bearing assemblies provides unstable support for the user's weight during the recreational activity and diminished balance and support for boot and skater.

It has been proposed to provide roller skates having wheels disposed in staggered relationship on the opposite sides of a central mounting beam. A device of this type is shown in U.S. Pat. No. 5,251,920 to McHale. However, such an arrangement in addition to not providing the performance characteristic of wheels which are of the classic in-line configuration, fails to address the issue of off-center loading of the individual bearing assemblies.

SUMMARY OF THE INVENTION

A polyurethane annular tire has a central opening into which is positively engaged an annular hard plastic mounting flange having mounting bores formed therethrough in spaced relation. The mounting flange is locked between a pair of cup-shaped hub rims. Each hub rim includes an annular hub ring formed centrally with an axial bore. An annular, axially inwardly projecting spacer lip is formed on the hub rim. The spacer lip defines a bearing gland. Each wheel includes a bearing assembly encased by the bearing gland. An outwardly angled tire seat flange is formed along the periphery of the hub ring of each respective hub rim. Hub bores are formed in spaced relation through the body of each hub rim. Hub bolts inserted through the hub and mounting bores lock the elastomeric tire in place. The tire seat flanges formed on the hub rims cooperate to form a V-shaped tire seat that supports the inner periphery of the polyurethane tire and directs impact force on the tire tread surface in a direct line to the bearings.

To enhance balance, stability, durability, and smoothness of ride, the respective bearing glands may be formed axially displaced in staggered relationship spaced to the opposite sides of the center of the skate shoe to displace each bearing assembly laterally outwardly away from the longitudinal center plane representing the load vector.

Other features and advantages of the invention will become apparent from the following detailed description, taken in conjunction with the accompanying drawings, which illustrate, by way of example, the features of the invention.

DESCRIPTION OF THE PREFERRED EMBODIMENT

Figure 1:
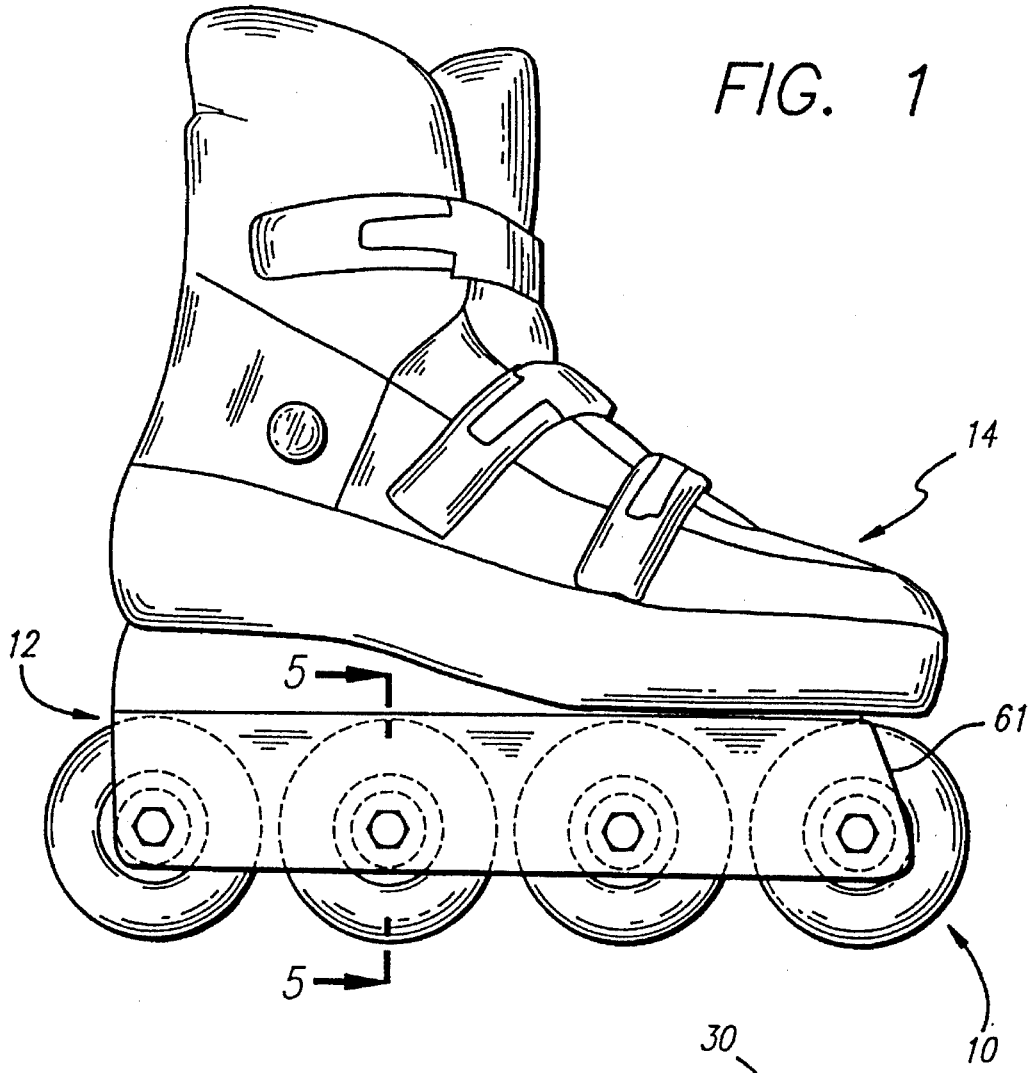
FIG. 1 is a side elevational view of an in-line roller skate embodying a novel feature of the invention.

As shown in the drawings for purpose of illustration, roller skate wheels are arranged in-line and mounted in spaced longitudinal relation between a pair of mounting rails carried from a boot. In accordance with the present invention, the skate wheel includes a hard plastic mounting flange positively lock fitted into an inner peripheral channel of an annular elastomeric polyurethane tire. A pair of aluminum alloy saucer-shaped hub rims sandwich the mounting flange. A plurality of spaced hub bolts project through the hub rims into the mounting flange locking the tire to the hub rim assembly. Respective outwardly angled tire seat flanges are formed on the outer periphery of each hub rim and cooperate to bear against the inner surface of the tire to provide support for the tire.

Figure 2:
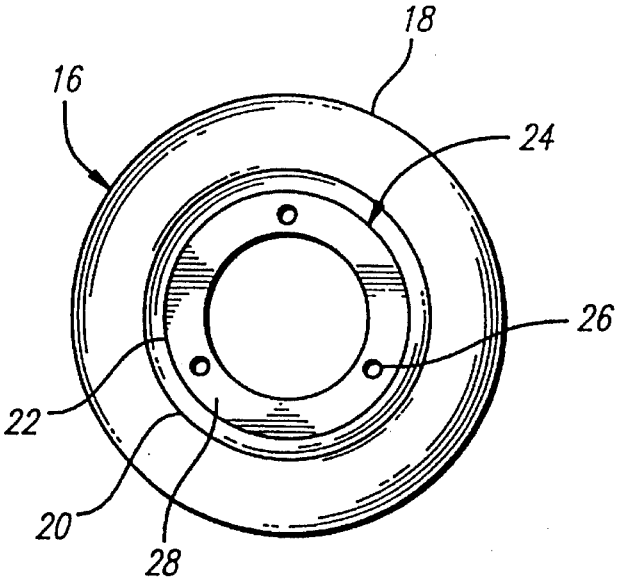
FIG. 2 is side view, in enlarged scale, of an elastomeric tire shown in FIG. 1 having a mounting flange coupled thereto.

Referring to FIG. 1, a series of in-line skate wheels 10 are mounted spaced longitudinally between a pair of linear mounting rail assemblies 12 mounted beneath a skate boot 14. Each skate wheel includes an elastomeric polyurethane annular tire 16 (FIG. 2 & 4) having an outer tire tread surface 18, a radially and axially inwardly angled annular bead seat surface 20, and a central opening 22. The bead seat surface 20 is V-shaped to converge radially inwardly from the lateral sides of the tire. A hard plastic annular mounting flange 24 constructed of, for instance, DELRIN™ is imbedded in the interior of the tire to project radially inwardly from the central opening 22. Three mounting bores 26 are formed through the body of the mounting flange 24 at equidistant positions, as shown in FIG. 2. The mounting flange is formed with a radially inwardly disposed mounting ring 28 disposed in such opening 22 and is constructed of a predetermined axial thickness.

Figure 3:
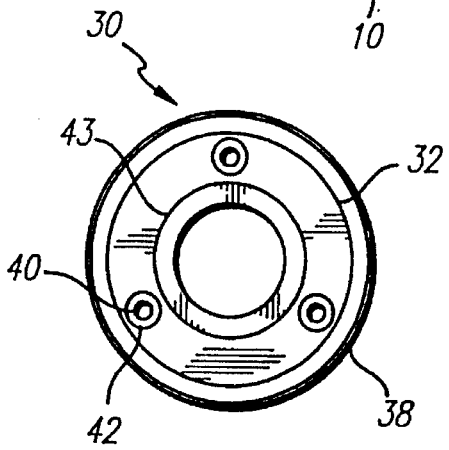
FIG. 3 is a side view, in enlarged scale, of a hub included in the skate shown in FIG. 1.
Figure 4:
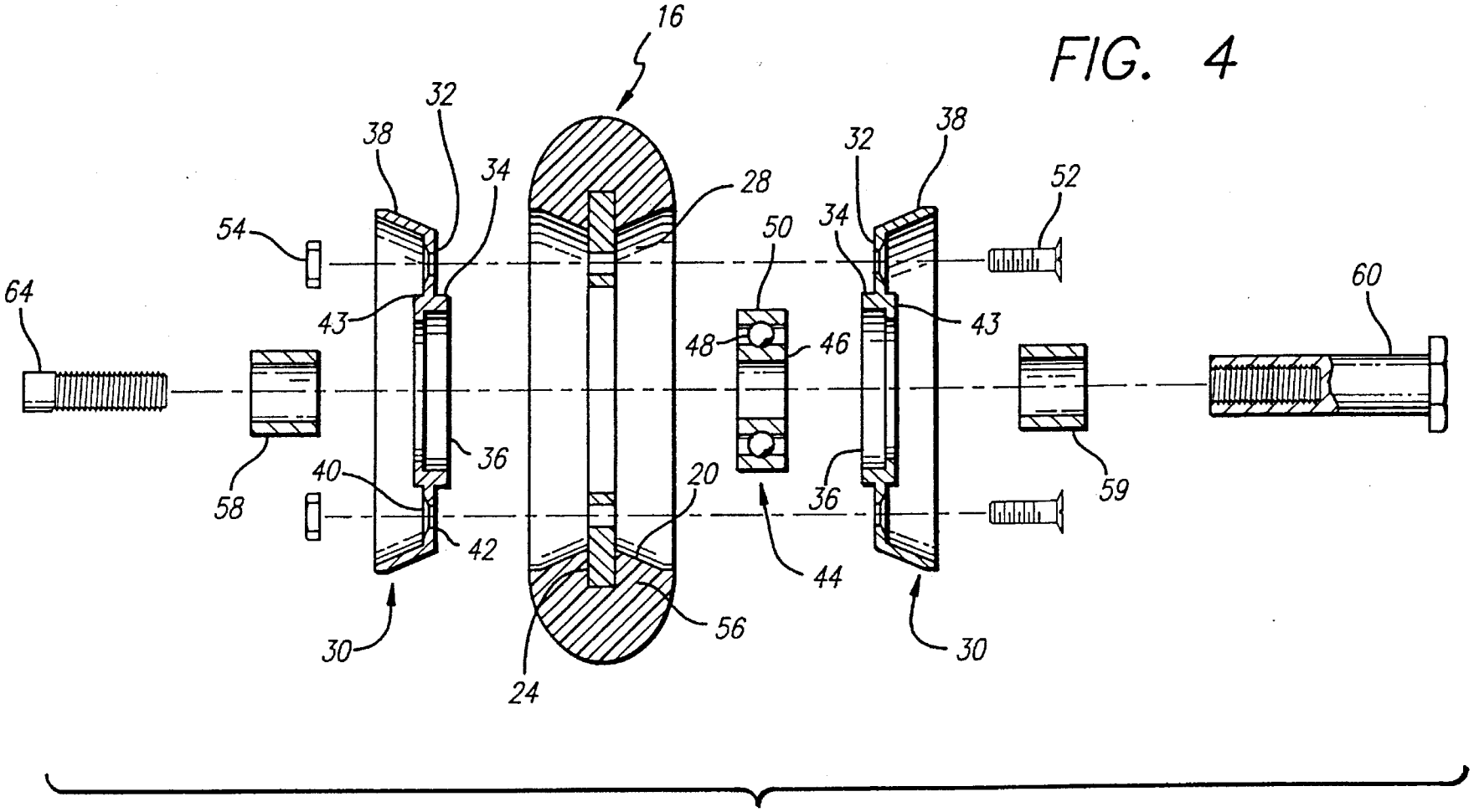
FIG. 4 is an exploded view, in enlarged scale, of a roller skate wheel included in the skate shown in FIG. 1.

A pair of cup-shaped hub rims 30 (FIG. 3) are received on the opposite sides of the tire to sandwich between the outer peripheries the mounting flange 24 thereof. The hub rims 30 are preferably composed of aluminum, but can comprise various types of rigid metal alloys and plastics. Such hub rims are constructed with outer annular hub rings 32 defining respective confronting annular faces spaced axially apart a distance sufficient to, when drawn together, be pressed against such mounting ring. Respective circular spacer lips 34 (FIG. 4) project axially from the radial inner peripheries of the respective hub rings 32 to cooperate in defining an annular bearing gland 36. The rims are formed at the outer peripheries with respective frusto-conical tire seat flanges 38 directed angularly outwardly, as shown in FIG. 4 and away from one another to cooperate in forming a composite V-shaped seat 56. A plurality of hub bores 40 (FIG. 3) extend axially through each hub ring 32 and are disposed in a pattern spaced 120° from one another.

Figure 5:
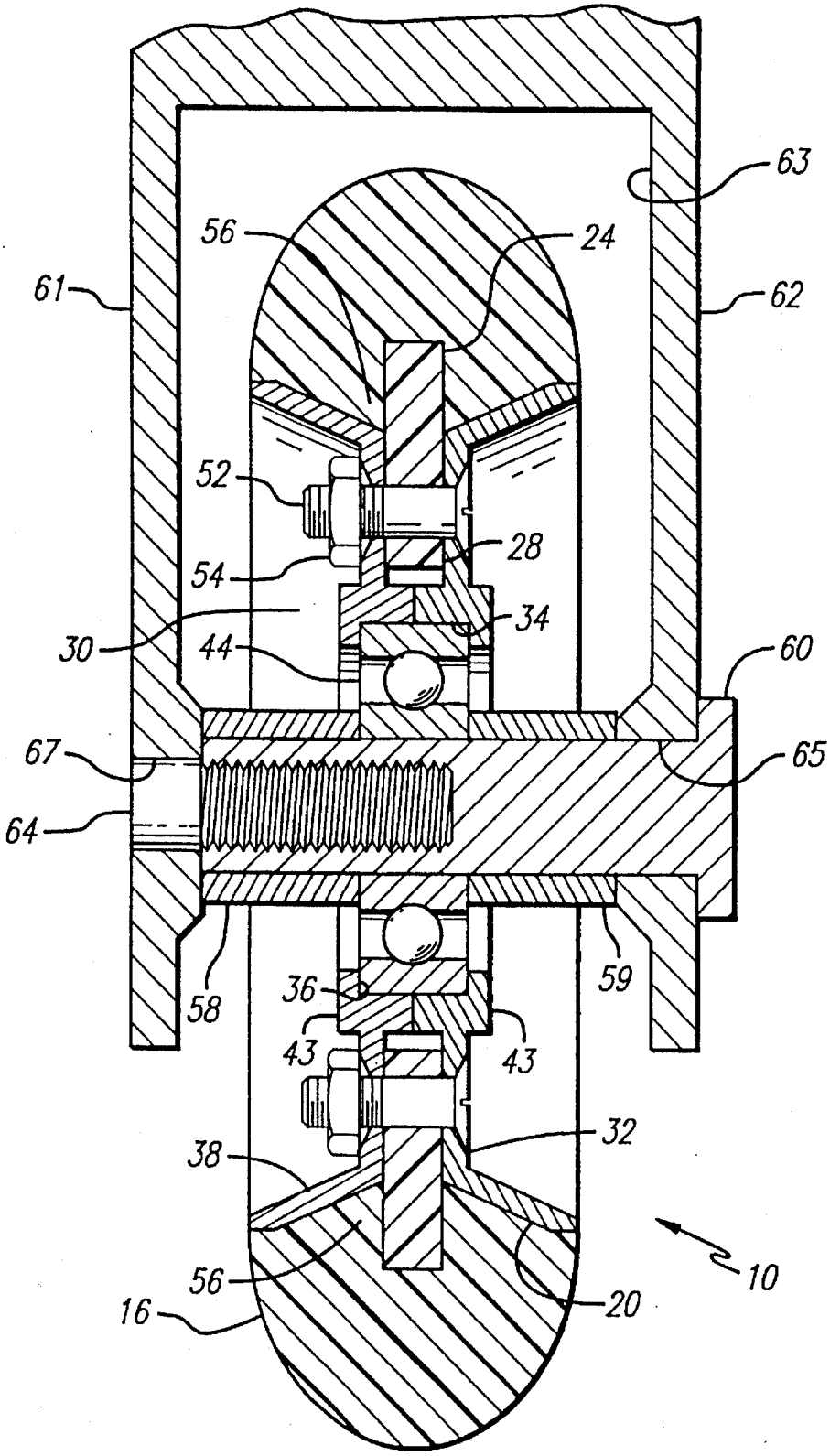
FIG. 5 is a cross-sectional view, in enlarged scale, taken substantially along the line 5—5 of FIG. 1.

Referring to FIGS. 4 and 5, it is noted that in practice the spacer lips 34 serve to maintain the rims in axially spaced relation and cooperate with respective axially outwardly extending bearing retainer flanges 43 which project radially inwardly to cooperate in forming end caps for the bearing gland 36 of a configuration for receiving a commercially available roller bearing assembly, generally designated 44. The bearing assembly 44 is composed of the conventional inner race 46, a plurality of ball bearings 48, and an outer race 50.

Referring to FIG. 5, the hub rims 30 are fastened together, sandwiching the bearing assembly 44 and the mounting ring 28, using a plurality of hub bolts 52 of nut 54 and thread construction. When the hub bolts 52 are tightened, the hub rings 32 are drawn to positively grip the opposite sides of the mounting ring 28. The frusto-conical tire seat flanges 38 when assembled flare axially outwardly away from one another to form a shallow V-shaped seat 56 for the elastomeric tire 16.

Referring to FIGS. 1, 4, and 5, the skate boot 14 includes the mounting rail assembly 12 configured with the laterally spaced apart mounting rails 61 and 62 formed therebetween with an elongated wheel well 63 which receives the respective wheels in their assembled condition. The rail 62 is formed along its length with longitudinally spaced apart enlarged mounting bores 65 for receipt of a female mounting axle bolt 60. The rail 61 is formed along its length with opposed bores 67 for receipt of respective fastener studs 64. The mounting axle assembly includes spacer sleeves 58 and 59 telescoped over the female axle bolt 60 and configured to be telescopically received within the respective annular openings formed by the retaining flanges 43 such that they engage the opposite sides of the respective bearing assemblies 44, in assembled condition, to maintain such bearing assemblies in their spaced relationship centered in the center of the wheel in direct radial alignment with the center of the tire and the mounting flange 24.

It will be appreciated that the skate wheel of the present invention is economical to manufacture and assemble. In this regard, the mounting flange 24 may be conveniently molded in place within the polyurethane tire 16. The rim disks 30 may conveniently be molded of hard plastic or machined to the desired configuration shown. The skates may then be easily assembled by selecting a pair of rim disks 30 and a bearing assembly 44 and assembling same within the interior of the tire, trapping the mounting ring 28 between the rim rings 32 and capturing the bearing assembly within the bearing gland 36. The screw and bolt assembly 52 may then be inserted through the hole patterns within the rim disks and the flange 24 to mechanically engage such disks and flange together and the nuts and bolts tightened to firmly drawn the disk together on the opposite sides of such flange 24 so that a firm, sturdy, and positive mechanical connection is made. The assembled wheels may then be conveniently installed on the rail assembly 12 in a conventional manner by merely arranging the respective wheels in position within the wheel well 63 and inserting the female mounting bolt 60 through the respective spacers 59 and arranging the wheel assemblies and cooperating spacer 58 in axial alignment as the bolt 60 is maneuvered into the position shown in FIG. 5 to assume a confronting relationship with the opposed fastener bore 67. The fastener stud or screw 64 may then be inserted and tightened down to secure the respective wheels firmly in position.

It will be appreciated by those skilled in the art that the wheel assembly must be capable of carrying, not only the weight of the skater, but must be capable of withstanding the additional forces applied thereto as a result of acceleration and deceleration forces applied during various maneuvers undertaken by the skater. In this regard, it will be understood by those of experience in the art that the tire 16 when loaded will tend to squat slightly at the bottom side of the wheel thus tending to create a slight bulge just forward of the tangent point of the vertical diameter through the tire. This bulge tends to somewhat resist rotation of the tire thereby creating a frictional rolling resistance. According to FIGS. 1 and 2, assuming the skater is skating forwardly to the right as the skate is viewed in FIG. 1, it will be appreciated that the wheels will tend to rotate clockwise as viewed in FIGS. 1 and 2. Depending on the load and efficiency of the bearing assembly, this rotation is resisted to some degree by a counterclockwise moment generated through the bearing assembly tending to resist such clockwise rotation. Consequently, the hub tends to resist rotation of the tire. This, coupled with a recognition of a degree of resistance afforded by the virtual rolling resistance afforded by any bulge forward of the vertical diameter of the tire, generates opposing moments of force between the tire and hub. This characteristic, particularly during warm weather and with heavy use resulting in heavy loads and by high-speed rotation, often times results in generation of additional heat within the tire and consequent temperature rise of the elastomeric material. All these factors combine together to cause the tire itself to tend to expand radially and come under force, separate from the bead seat, and also causes the tire to tend to rotate or move relative to the rim thus tending to "walk around" the rim. However, for the construction of the present invention, it will be appreciated that such tendency of the tire to rotate relative to the hub is positively resisted at each mounting screw 52. That is, the mounting flange being embedded in the tire 16 during the molding of such tire and the mechanical lock within the annular cavity receiving such flange tends to maintain a positive bond such that relative movement between such flange and the tire is positively resisted. Then, the flange itself being constructed of relatively rigid material, such as for instance, DELRIN™, provides a rigid link for mechanical connection to the rigid rim disks 30 so that relative movement is positively resisted. As a consequence, the tendency of the tire to bulge forward of the ground contact point, rather than building up for a full revolution or even multiple revolutions, is dissipated three times during each revolution of the tire. This minimizes the consequent resistance to rotation, heat build up, and counteracting forces tending to dismount the tire from the hub.

With continued reference to FIG. 4, a further important advantage of the present invention is the manner in which impact forces are transmitted from the point of impact on the tread of the tire 16 to the bearing assembly 44. It will be appreciated by those skilled in the art that should a ridge, irregularity, or other abrupt rise in the terrain be encountered by one of the tires 16 generating a radially upward force centrally on such tire, the force will be in direct axial alignment with the relatively rigid centrally located mounting flange 24 such that the impact force will be transmitted directly to such mounting flange and through the mounting flange centrally to the respective hub rims 30 to be driven directly against the bearing assembly along the general center line of the wheel itself. This then tends to load the tire, and consequently the bead seat 20 on the axially inward portions of the seat flanges 38 thereby avoiding excessive loads on the axially outer extremities of the cantileverally extending flanges 38 so as to avoid excessive bending moments thereon and the consequent overstressing of such flanges.

From the foregoing, it will be appreciated that the skate wheel assembly of the present invention provides a relatively inexpensive, sturdy wheel construction which minimizes the tendency for an elastomeric tire to dismount the hub and tends to minimize frictional rolling resistance. Moreover, such wheel construction provides for efficient loading of impact forces upon the hub assembly in such a manner as to allow for an efficiency in design and provide for a long and trouble free life.

Figure 6:
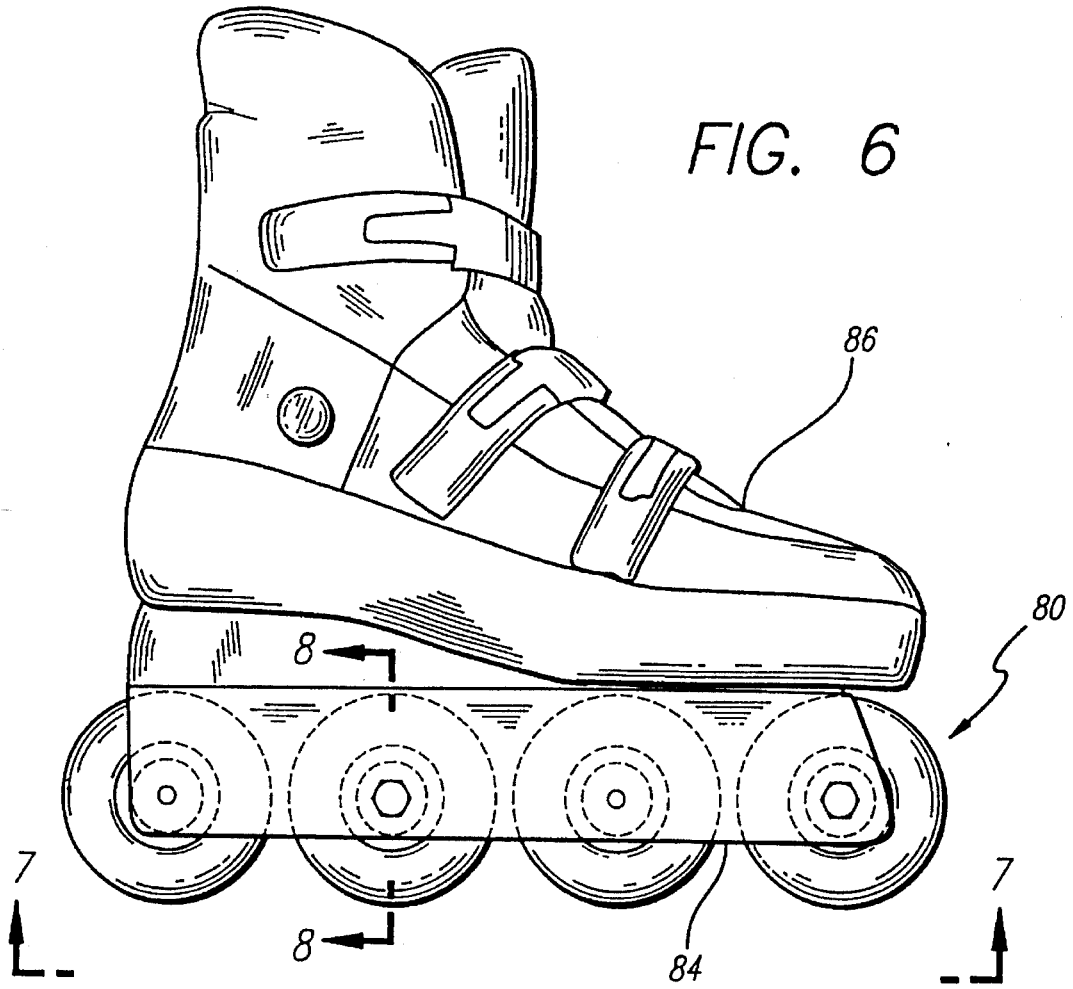
FIG. 6 is a side elevational view of an in-line roller skate embodying an additional novel feature of the present invention.
Figure 7:
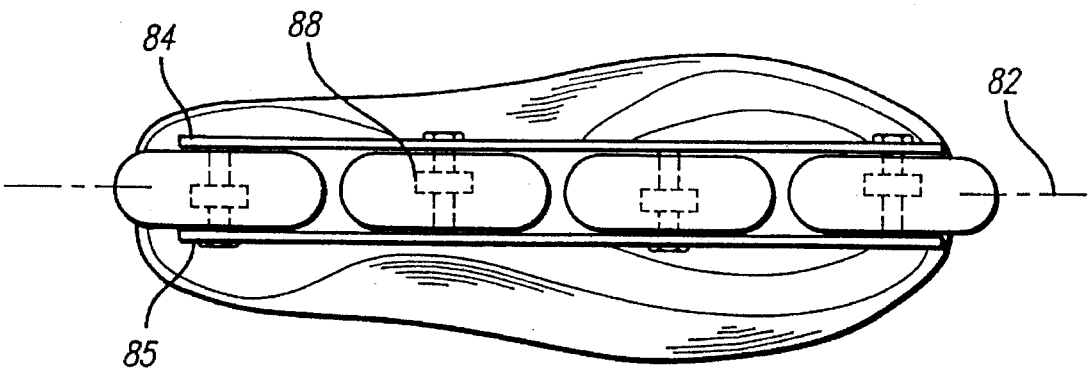
FIG. 7 is a bottom plan view taken substantially along line 7—7 of FIG. 6.

Referring to FIG. 6, a second embodiment of the present invention includes a series of roller skate wheels 80 arranged in-line along a longitudinal center plane 82 (FIG. 7) and mounted to a pair of mounting rails 84 and 85 fastened to the bottom of a boot 86, as shown in FIGS. 6 and 7.

In the preferred embodiment, each skate wheel 80 is mounted on a single ball bearing assembly 88. The ball bearing assembly 88 is mounted in the wheel 80 displaced axially from the center of the wheel and from the center plane 82 (FIG. 7) between the pair of mounting rails 84 and 85. The wheels 80 are reversed along the center plane 82 to displace their respective bearing assemblies 88 alternately to the opposite sides of the center plane 82, as shown in FIG. 7.

Figure 8:
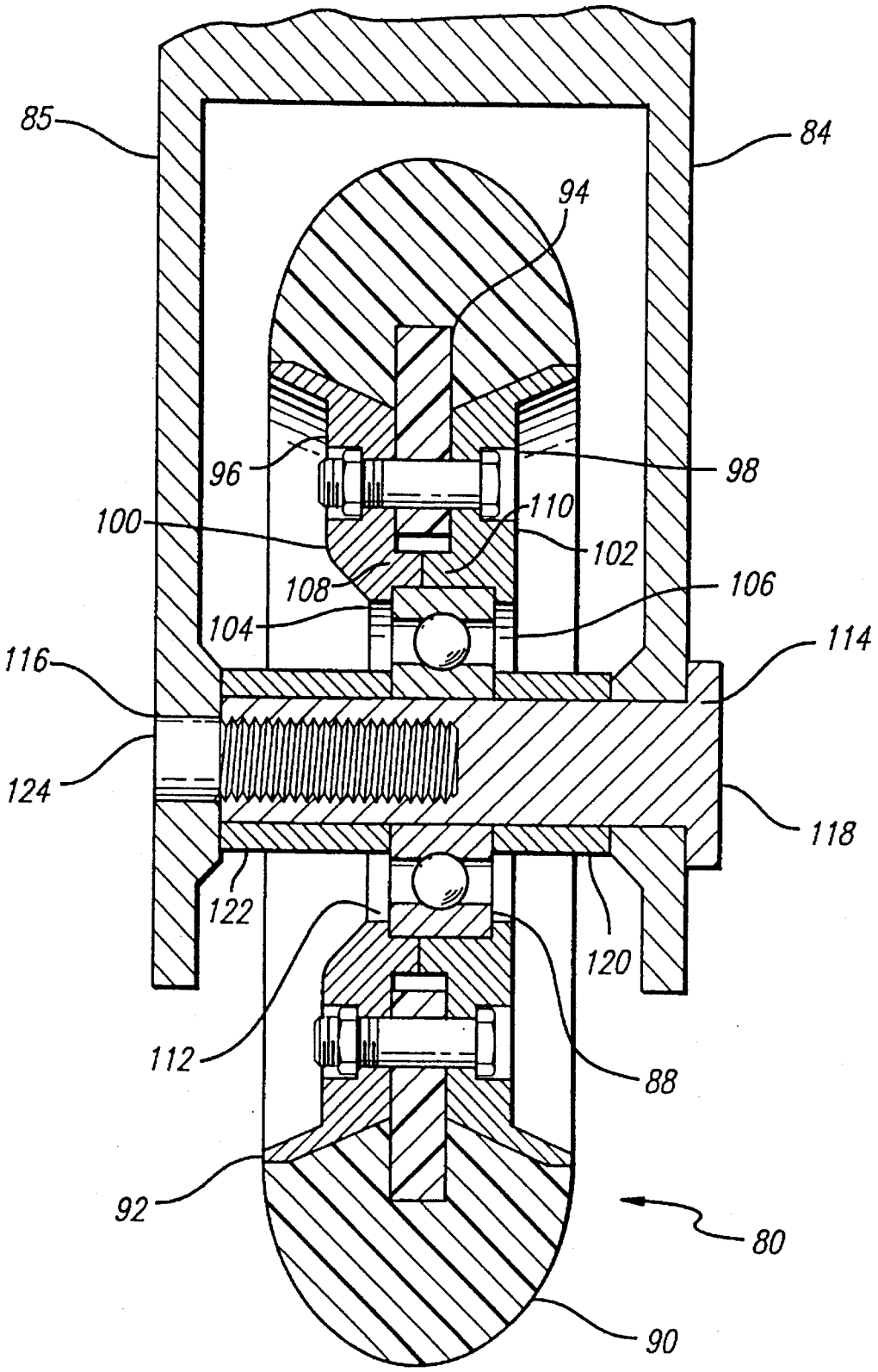
FIG. 8 is a cross-sectional view, in enlarged scale, taken substantially along the line 8—8 of FIG. 6.

Referring to FIG. 8, the skate wheel 80 includes a polyurethane tire 90 having a central opening 92. An annular hard plastic mounting flange 94 is positively engaged into the central opening 92. The mounting flange is locked between a pair of cup-shaped aluminum hub rims 96 and 98.

Each hub rim includes an annular hub ring 100, 102 formed centrally with an axial bore 104, 106. An annular, axially inwardly projecting spacer lip 108, 110 is formed on each hub rim. The spacer lips 108, 110 define a bearing gland 112. The bearing assembly 88 is encased by the bearing gland 112.

The pair of hub rims are configured such that the bearing gland is axially displaced to a lateral side of the longitudinal center line 82 (FIG. 7) cooperating to displace the bearing assembly 88 seated therein laterally outwardly away from the longitudinal center line, as shown in FIG. 8.

The mounting rails 84 and 85 are formed with respective mounting bores 114, 116 and spaced therealong as shown in FIG. 7. A female mounting bolt 118 (FIG. 8) is received in the bore 114 to span the wheel well, telescoped through a stub spacer sleeve 120 through the inner race of the bearing assembly 88 and through a spacer sleeve 122 to secure such bearing assembly 88 captive between the spacer sleeves 120, 122 and on the mounting bolt 118. Received through the bore 116 is a fastener stud 124 which serves to secure the bolt 118 in supporting position.

The wheels are thus configured to be advantageously mounted between the mounting rails in alternating orientation so that the bearing assemblies are alternately on opposite sides of the longitudinal center plane. The vector of the load for each bearing is disposed axially inwardly for the respective bearing to provide constant loading of each bearing assembly outwardly away from the longitudinal center plane. Because the bearings are always loaded toward the same side of each bearing, the orientation of the outer race through the bearings to the inner race is maintained constant. The offset in loading causes a slight torque in respective transverse planes to thus cause the load to restrict relative axial movement between the races of the bearing assembly during operation. This ensures that performance is not affected by play in the bearings and tends to maintain a stabilized loading of the respective bearings, alternating to the opposite sides of the respective wheels, to provide for enhanced stability and to make any bearing assembly employed in the manufacture of the wheel feel more precise.

While several forms of the invention have been illustrated and described, it will also be apparent that various modifications can be made without departing from the spirit and scope of the invention.

What is claimed is:

1. A roller skate wheel for mounting from a roller skate axle and comprising:

a pair of annular saucer-shaped hub rims formed with central openings for passage of said axle, including annular axially inwardly directed spacer lips cooperating to form a roller bearing gland surrounding said openings and radiating outwardly to form axially spaced apart hub rings cooperating to form therebetween a radially outwardly opening annulus, said rings being formed with a pattern of hub bores spaced equidistant thereabout, said rims projecting further radially outwardly to then flare axially outwardly away from one another to form tire seat flanges that cooperate in forming an annular tire seat;

an elastomeric annular tire formed with a radially outward tread surface and a radially inward facing bead surface configured to nest on said tire seat;

a mounting flange formed with a radially outer extent embedded in said tire and projecting radially inwardly to define a mounting ring for receipt in said annulus and including a pattern of mounting bores aligned with said hub bores; and hub bolts for receipt in the respective said hub and mounting bores to fasten said hub rims together fixedly securing said hub rims to said mounting ring to thereby mechanically lock said tire to said hub rims to positively prevent relative rotation of said tire with respect to said rims.

2. A roller skate wheel as recited in claim 1 wherein:

said tire is constructed of a relatively resilient elastomeric material.

3. A roller skate wheel as recited in claim 2 wherein:

said resilient elastomeric material is polyurethane.

4. A roller skate wheel as recited in claim 1 wherein:

said mounting flange is constructed of a relatively rigid material.

5. A roller skate wheel a recited in claim 4 wherein:

said rigid material is hard plastic.

6. A roller skate wheel as recited in claim 1 wherein:

said pair of hub rims are constructed of metal.

7. A roller skate wheel as recited in claim 6 wherein:

said metal is aluminum.

8. A roller skate wheel as recited in claim 1 wherein:

said pair of hub rims are formed to flare axially outwardly away from one another to form a seat having shallow V-shaped cross-section.

9. A roller skate wheel as recited in claim 8 wherein:

said tire is formed with a radially inwardly facing bead surface configured in a shallow V-shaped cross-section complementing the V shape of said seat.

10. A roller skate wheel as recited in claim 1 wherein:

said pair of hub rims cooperate to form a central annularly shaped roller bearing assembly gland.

11. A roller skate wheel as recited in claim 1 wherein:

said wheel is molded with said mounting flange embedded therein.

12. A roller skate wheel as recited in claim 1 wherein:

said mounting flange is formed with said mounting ring of a predetermined thickness; and said pair of hub rims are configured with said hub rings spaced axially apart a distance to form said annulus of an axial thickness slightly less than said predetermined axial thickness such that drawing together axially said pair of hub rims will press said hub rings firmly against the opposite sides of said mounting ring to clamp said mounting ring firmly therebetween.

13. A roller skate wheel as recited in claim 12 wherein:

said hub bolts are of nut and thread construction and are configured to, when tightened, draw said hub rings firmly against the opposite sides of said mounting ring.

14. A roller skate wheel as recited in claim 1 wherein:

said pair of hub rims are of symmetrical shape about a radial central plane and said tire seat flanges cooperate to form said tire seat to converge axially and radially inwardly toward said central plane to thereby direct impact force from said tread surface of said tire through said mounting ring to said spacer lips and radially inwardly to said bearing gland.

15. A roller skate wheel as recited in claim 1 wherein:

said hub rims are formed on their radially inward extents with respective axially spaced apart retainer flanges.

16. A roller skate wheel as recited in claim 1 wherein:

said hub rims and mounting flanges are constructed of rigid materials.

17. A roller skate wheel as recited in claim 1 including:

a bearing assembly in said bearing gland and including an inner race, a plurality of bearings, and an outer race.

18. A roller skate wheel for mounting from a roller skate axle disposed perpendicular to a pair of longitudinal mounting rails spaced laterally apart equidistant on opposite sides of a longitudinal center plane and comprising:

a pair of annular saucer-shaped hub rims formed with central openings for passage of said axle, including annular axially inwardly directed spacer lips cooperating to form a roller bearing gland offset to a lateral side of said central plane surrounding said openings and radiating outwardly to form axially spaced apart hub rings cooperating to form therebetween a radially outwardly opening annulus, said rings being formed with a pattern of hub bores spaced equidistant thereabout, said rims projecting further radially outwardly to then flare axially outwardly away from one another to form tire seat flanges that cooperate in forming an annular tire seat;

a bearing assembly in said bearing gland having an inner race for receipt on said axle, a plurality of ball bearings, and an outer race for carrying said pair of hub rims from said pair of rails such that, when loaded, said bearings are loaded at an opposite side of said longitudinal central plane to said lateral side;

an elastomeric annular tire formed with a radially outward tread surface and a radially inward facing bead surface configured to nest on said tire seat;

a mounting flange formed with a radially outer extent embedded in said tire and projecting radially inwardly to define a mounting ring for receipt in said annulus and including a pattern of mounting bores aligned with said hub bores; and hub bolts for receipt in the respective said hub and mounting bores to fasten said hub rims together fixedly securing said hub rims to said mounting ring to thereby mechanically lock said tire to said hub rims.

19. An in-line roller skate as recited in claim 18 wherein:

said mounting flange is formed of relatively hard inelastic plastic;

said tire is formed of polyurethane; and each said pair of hub rims is formed of aluminum.

20. An in-line roller skate comprising:

a pair of longitudinal mounting rails spaced laterally apart equidistant on opposite sides of a longitudinal center plane to form therebetween a wheel receiving track and having a plurality of axle receiving holes spaced longitudinally therealong;

a plurality of wheels spaced longitudinally apart in said track, each including a pair of hubs oppositely oriented and configured with a single bearing gland offset to a lateral side of said central plane, the bearing glands of alternate ones of said wheels being offset equidistant to the opposite sides of said longitudinal center plane;

axle bolts for receipt in said axle receiving holes for mounting the respective said wheels therefrom; and a single bearing assembly in each respective gland for supporting said rails from the each respective wheel so that, when loaded, the alternate ones of said bearings is loaded at alternate opposite sides of said longitudinal center plane.

* * * * *